US005675921A

United States Patent [19]

Lin

[11] Patent Number: 5,675,921

[45] Date of Patent: Oct. 14, 1997

[54] TRANSMISSION STRUCTURE FOR A CRYSTAL-LIKE BALL

[76] Inventor: Hsi-Chun Lin, P.O. Box 96-405, Taipei 10098, Taiwan

[21] Appl. No.: 616,592

[22] Filed: Mar. 15, 1996

[51] Int. Cl.[6] ..... G09F 19/00

[52] U.S. Cl. ..... 40/409; 40/411; 40/414; 74/665 GC

[58] Field of Search ..... 40/406, 409, 410, 40/411, 414; 446/156, 236, 267, 357; 74/665 GC, 665 F

[56] References Cited

U.S. PATENT DOCUMENTS

| | | | |
|---|---|---|---|
| 4,852,283 | 8/1989 | Teng | 40/410 X |
| 4,983,890 | 1/1991 | Satoh et al. | 40/414 X |
| 5,088,218 | 2/1992 | Lin | 40/411 |
| 5,134,795 | 8/1992 | Wang | 40/411 |
| 5,555,656 | 9/1996 | Liu | 40/410 X |

*Primary Examiner*—Brian K. Green
*Attorney, Agent, or Firm*—Bacon & Thomas

[57] ABSTRACT

A transmission structure is set forth for a crystal-like ball, which comprises a glass ball and a rubber seal; the center of the rubber seal has a tube-shaped round hole for receiving a shaft of a rotary structure; the shaft extends from the inside of the glass ball to the outer end of the rubber seal, and connects with a universal joint; the shaft is to be driven in rotation with a transmission structure so as to actuate an ornament in the glass ball to rotate. The outer edge of the open end of the glass ball is connected with the upper edge of a hollow and round ornament; the bottom edge of the hollow and round ornament is glued onto an outer top surface of a base disc on a base. The hollow and round ornament is a transparent member, through which a rotary ornament therein can been seen. The bottom edge of the rotary ornament is glued onto the ring surface of the turntable on the base; the turntable is mounted on a projected ring of the base disc. The upper edge of the turntable is engaged with a small gear of the transmission structure by means of an inner gear of a ring member. The center of the base disc is mounted with a music generator having a driving spring to actuate a driving gear to drive the transmission structure so as to have both an ornament inside the glass ball and the ornament in the hollow and round ornament rotated.

14 Claims, 8 Drawing Sheets

TRANSMISSION STRUCTURE FOR A CRYSTAL-LIKE BALL

BACKGROUND OF THE INVENTION

1. Field of the Invention

This invention relates to an ornamental crystal-like ball, and in particular to a crystal-like ball having a rotary inner ornament and outer ornament.

2. Description of the Prior Art

In the conventional crystal ball, such as U.S. Pat. No. 5,134,795, a center shaft thereof extends into a glass ball; the center shaft mounted in the center hole of a gear has an O-ring to provide a hermetical seal. The upper end of the center shaft has a claw-like member to drive a blade propeller to rotate, and the center shaft is connected with a gear to engage with another gear; then, an ornament on the gear will be driven to rotate as a result of the center shaft.

In another conventional crystal ball, such as U.S. Pat. No. 5,088,218, the crystal ball has a space under the crystal ball; a crown gear and driving gear of the music generator are engaged with each other. The upper part of the center shaft of the crown gear has a drive claw. The opening end of the glass ball is mounted with a rubber plug, of which the center is mounted with a disc; the center of the disc has a liquid seal, and a rotary shaft mounted through the liquid seal; one end of the rotary shaft is mounted with an axle coupling to connect with the driving claw; when the music generator rotates, the driving gear will drive the driving claw on the center shaft to rotate, and then the driving claw will come in contact with a coupling on the end of the disc shaft so as to drive the ornament on the rotary disc in the glass ball to rotate; the coupling under the lower part of the center shaft of the rotary disc will be cross-linked with the driving claw on the upper part of the center shaft to provide a transmission function without deviation from the center line of the two parts, i.e., the ornament in the glass ball will have a steady rotation, and a perfect hermetical seal can also be provided between the rotary disc and the base.

SUMMARY OF THE INVENTION

The prime object of the present invention is to provide a transmission structure for a crystal-like ball, in which the base disc of the base and the turntable are mounted with a ornament and a rotary ornament respectively. In the base, there is a driving gear of the music generator to drive a transmission structure above the base so as to cause the turntable to rotate and also to cause an ornament in the glass ball to turn.

Another object of the present invention is to provide a transmission structure for a crystal-like ball, in which the base disc of the base is mounted with a turntable, a positioning disk and a ring member; the center of the turntable has a salient ring, of which the inner side has a flange to be divided into two surfaces, i.e., an upper surface and a lower surface. The lower-surface is used for mounting on a vertical ring surface of the base disc to guide rotation; the upper surface is used for mounting a positioning disk. By means of the positioning flange outside the vertical members and/or corresponding structure generator, the music generator is fastened in the positioning disk so as to have the base parts assembled into one piece. The driving gear of the music generator can drive the transmission structure so as to make an ornament on the turntable rotate.

Still another object of the present invention is to provide a transmission structure for a crystal-like ball, in which the rotary ornament is to be driven to rotate by means of an inner gear in the ring member engaged with a small gear of the transmission structure; when the driving gear of the music generator rotates, the ornament on the turntable will rotate by means of a driving force between the small gear and the inner gear.

A further object of the present invention is to provide a transmission structure for a crystal-like ball, in which a transmission structure is mounted on a frame over the music generator; a crown gear is engaged with a driving gear of the music generator; the cylindrical hole of the crown gear is pivotally connected with a short shaft under the small gear; a rotary shaft is furnished on the small gear, and is mounted with a positioning spring, and then passes through a shaft socket on the frame. The rotary shaft has a cut surface on the upper end thereof to be connected with the positioning seat of a transmission gear; then, a screw passes through the round hole of the transmission gear, and is fitted into a screw hole on the end of the rotary shaft. The bottom side of the small gear is in contact with the crown gear, being fastened together with a washer and a screw. The positioning spring on the small gear enables the crown gear to press towards the driving gear of the music generator so as to have the two gears engaged closely.

A still further object of the present invention is to provide a transmission structure for a crystal-like ball, in which the short shaft under the small gear is connected with the crown gear, and then a washer and a screw are used to have the gears fastened together so as to provide sufficient frictional force between the gears to drive the small gear in rotation. In case of an unexpected resistance occurring, the frictional force will be overcome by such resistance; then, the contact surface between the crown gear and the small gear will become a slippery surface so as to prevent the two parts from being damaged.

Yet another object of the present invention is to provide a transmission structure for a crystal-like ball, in which a universal joint is provided between the transmission structure and the rotary structure; by means of the guide effect of the universal joint, the rotary shaft of the turntable in the glass ball can have a better balance; a shaft seal is furnished around the shaft of the turntable to prevent water leakage.

DETAILED DESCRIPTION OF THE PREFERRED EMBODIMENT

Figure 1:
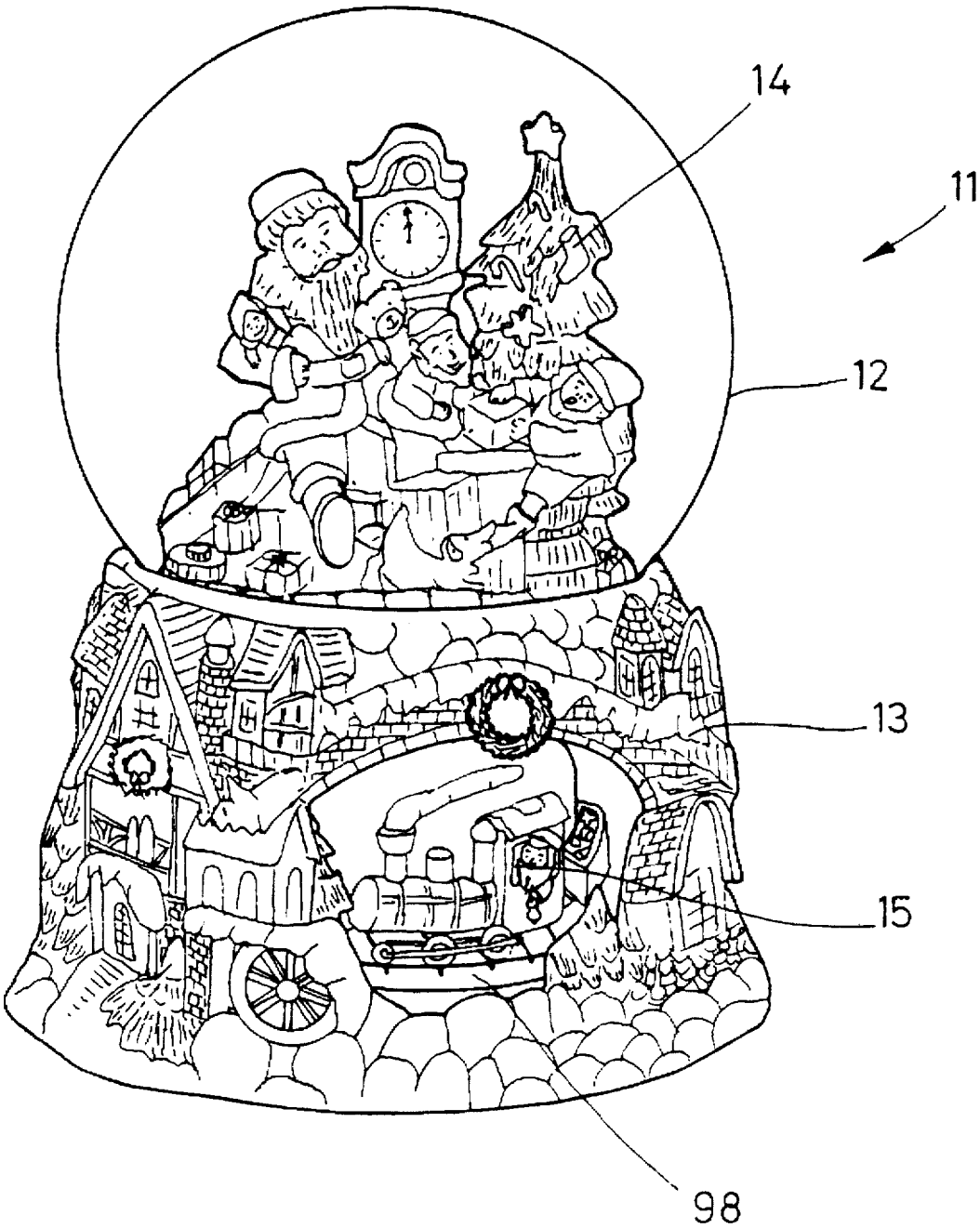
FIG. 1 is a perspective view of the outer part of the present invention.
Figure 2:
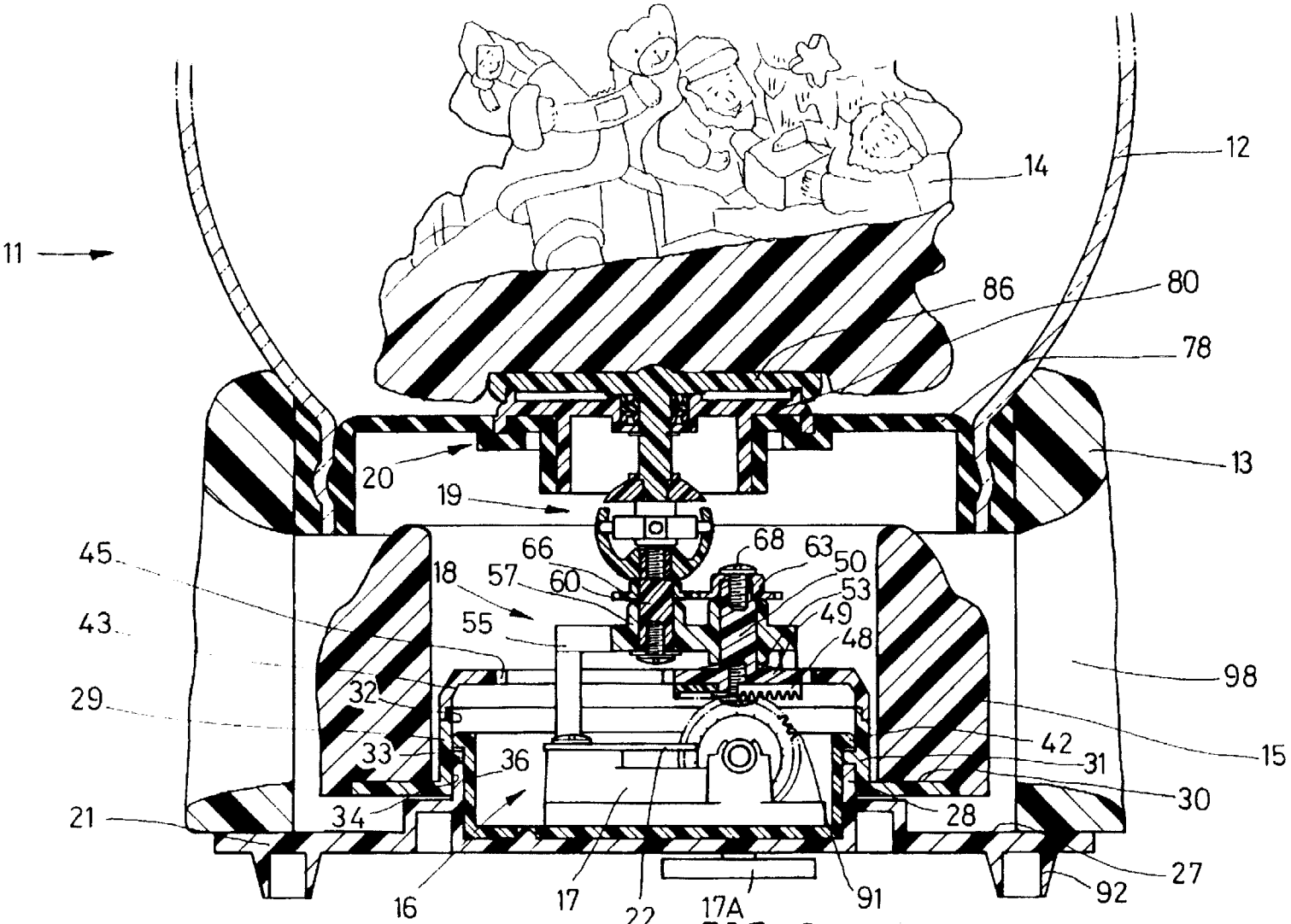
FIG. 2 a sectional view of the present invention, showing the inner structure thereof.

Referring to FIGS. 1 and 2, the present invention relates to a transmission structure for a crystal-like ball 11, which comprises a glass ball 12; the open end of the glass ball 12 is sealed with a rubber seal 78 to prevent water inside the glass ball 12 from leaking out. The center of the rubber seal 78 has a tube-shaped round hole 79 for receiving a rotary structure 20 extended from the inside space of the glass ball 12 to the outside of the open end, and then it is connected with a universal joint 19 on the transmission structure 18 through a connecting rod 88 of a shaft 87. It can be driven to rotating by means of the transmission structure 18 so as to have the ornament 14 in the glass ball 12 to turn. There is at least one shaft seal 85 to be mounted between the shaft 87 and the shaft seal seat 81 in the center of the positioning disk 80; the shaft seal 85 is used for preventing the water in the glass ball 12 from leaking out. The outer surface of the open end of the glass ball 12 is connected with the upper edge of a hollow and round ornament 13; the bottom edge of the hollow and round ornament 13 is glued to the outer edge of the top surface 27 of the base disc 21 of the base 16. A rotary ornament 15 is mounted within the fixed ornament 13, and the bottom thereof is glued to a top surface 30 of the turntable 29 of the base 16. The upper edge of a salient or projecting ring 31 of the turntable 29 is connected with a ring member 43, of which the inner surface is furnished with an inner gear 45 to be engaged with a small gear 49 of the transmission structure 18. A music generator 17 is fixed in the base 16, and its driving spring can be wound on a shaft with key 17A. The driving gear 91 of the music generator 17 can drive the transmission structure 18 to actuate the ornaments 14 in the glass ball 12 and the ornaments 15 in the hollow and round ornament 13 to turn.

Figure 3:
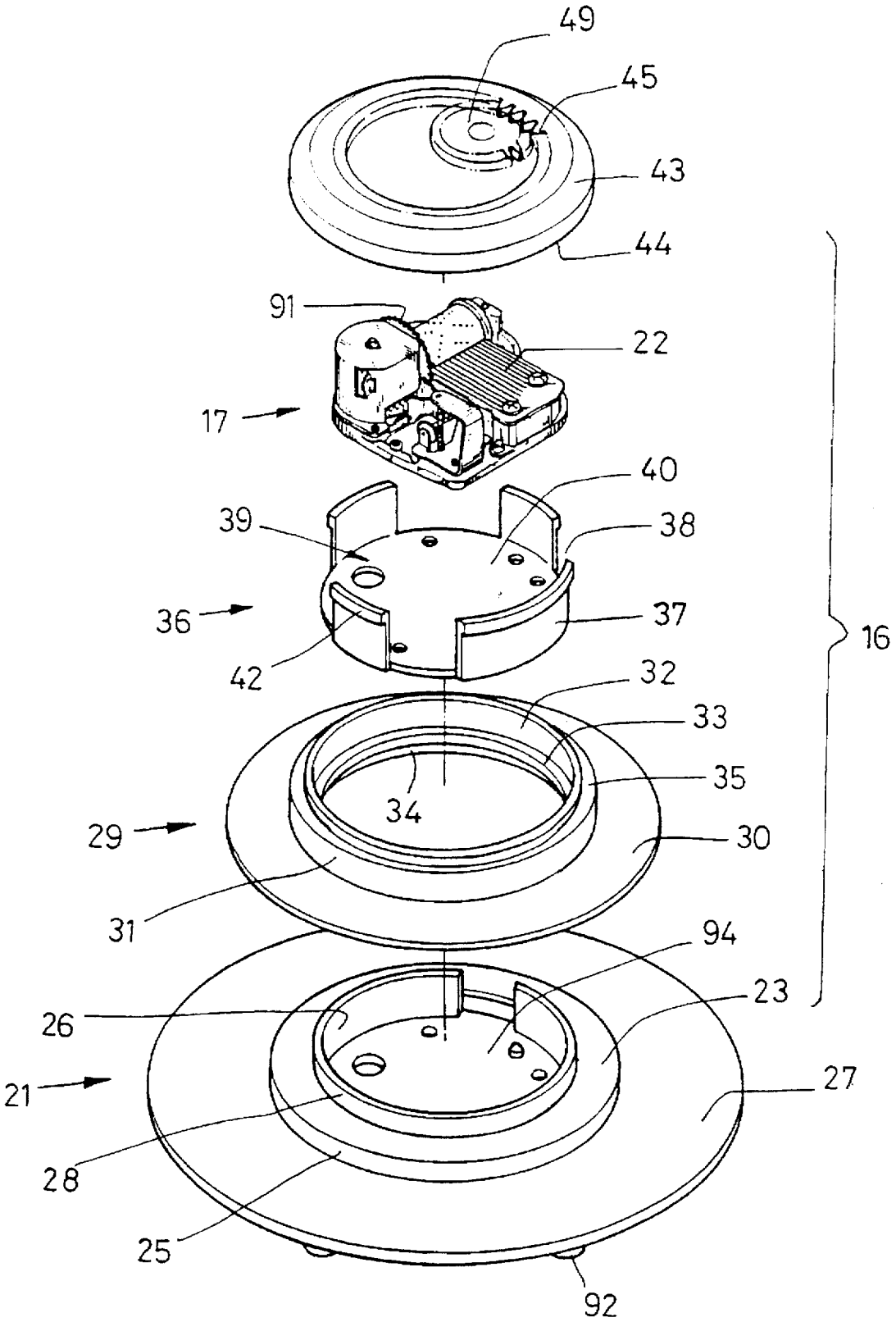
FIG. 3 is a disassembled view of the present invention, showing the structure of the base thereof.

Referring to FIGS. 2 and 3, the base 16 includes a base disc 21, a turntable 29, a positioning disk 36, a ring member 43, an inner gear 45 and a music generator 17. The base disc 21 is a ring-shaped disc furnished with a plurality of support studs 92 arranged symmetrically so as to support the whole crystal ball. The top surface of the base disc 21 is provided with two top surfaces 23 and 27, a flat surface 94, and a projected ring 28 between the top surface 23 and the flat surface 94. The top surface 23 has a vertical ring surface 25. The top surface 23 has a higher level than that of the top surface 27. The height of the projected ring 28 of the base disc 21 is equal to or slightly higher than the depth of the lower ring surface 34 of the turntable 29 so as to facilitate mounting the turntable 29 to mount on the projected ring 28 of the base disc 21. The inside center of the base disc 21 is a flat surface 94 for mounting the bottom of the positioning disc 36 by means of screws, and the turntable 29 and the base disc 21 will be fastened together. The outer edge of the top surface 27 of the base disc 21 is glued together with the bottom edge of the hollow and round ornament 13, which is deemed to be the prime ornament of the crystal-like ball 11. The ornament 13 has a proper transparent and see through portion 98 so as to enable a person to see the rotary ornament 15 glued on the top surface 30 of the turntable 29. The turntable 29 has a ring surface 30 to be glued with the bottom of the ornament 15; the inner edge of the ring surface 30 has a salient ring 31 with a ring shoulder 35 to be mounted with a contact portion 44 of a ring member 43. The inside of the salient ring 31 is furnished with two surfaces, i.e., an upper surface 32 and a lower surface 34, which are separated with a flange 33 having a suitable thickness, and the inner diameter thereof is equal to or slightly larger than the diameter of the inner surface 26 of the projected ring 28 on the base disc 21. The height of the lower surface 34 under the flange 33 is equal to or slightly smaller than that of the projected ring 28. After the turntable 29 is connected with the base disc 21, the lower side of the flange 33 is connected with the upper side of the projected ring 28 of the base disc 21, while the bottom surface of the turntable 29 and the top surface 23 of the basic disc 21 are separated from each other by a small distance. The space between the upper edge of the flange 33 and the upper surface 32 is used for receiving the positioning flange 42 on the positioning disk 36; the bottom surface of the positioning disk 36 and the flat surface 94 in the base disc 21 are in contact with each other; then, the aforesaid parts are fastened to the base disc 21 by means of screws or by the music generator 17.

The positioning disk 36 in contact with the flat surface 94 of the base disc 21 has a plurality of vertical members 37 and a flat bottom 40 to be in contact with the flat surface 94 of the base disc 21. The center of the vertical members 37 has a hollow portion 39 for mounting the music generator 17 on the flat bottom 40. Among the vertical members 37, there are several positioning slots 38 of different sizes. The positioning slots 38 and the hollow portion 39 form a space for mounting and positioning the music generator 17. The outer diameter of the vertical members 37 of the positioning disk 36 is equal to or smaller than the inner diameter of the flange 33 of the turntable 29 so as to facilitate the vertical members 37 of the positioning disk 36 to be mounted in the salient ring 31 and the projected ring 28. The upper ends of the vertical members 37 are furnished with positioning flanges 42. By means of screws or the music generator 17, the base 16 can be assembled together in a space between the flange 33 of the turntable 29 and the upper surface 32.

The ring member 43 connected together with the ring shoulder 35 of the salient ring 31 on the turntable 29 has a ring shoulder the same size as that of the inner and outer ring surfaces of the salient ring 31 of the turntable 29; the aforesaid two parts can be assembled together by means of either or two methods, of which one is an ultrasonic welding method, while the other is a screw-connection method; before making screw-connection, the two surfaces are coated with a glue so as to provide a permanent connection. The upper side of the ring member 43 is furnished with an inner gear 45 to be engaged with a small gear 49 of the transmission structure 18 so as to enable the transmission structure 18 to drive the turntable 29 under the ring member 43 to rotate, and then the ornament 15 on the ring surface 30 will be driven to rotate.

The music generator 17 is mounted on the flat bottom 40 in the positioning disk 36; the music generator 17 has a shaft extending through a round hole to a bottom space of the base disc 21; the driving spring of the music generator 17 is to be wound by winding the knob 17A. The power of the driving spring is to transmitted, through a retarding gear train, to a music drum, which can actuate a plurality of music reeds 22 to produce music; simultaneously, the transmission structure 18 will be driven to move by a driving gear 91.

Figure 4:
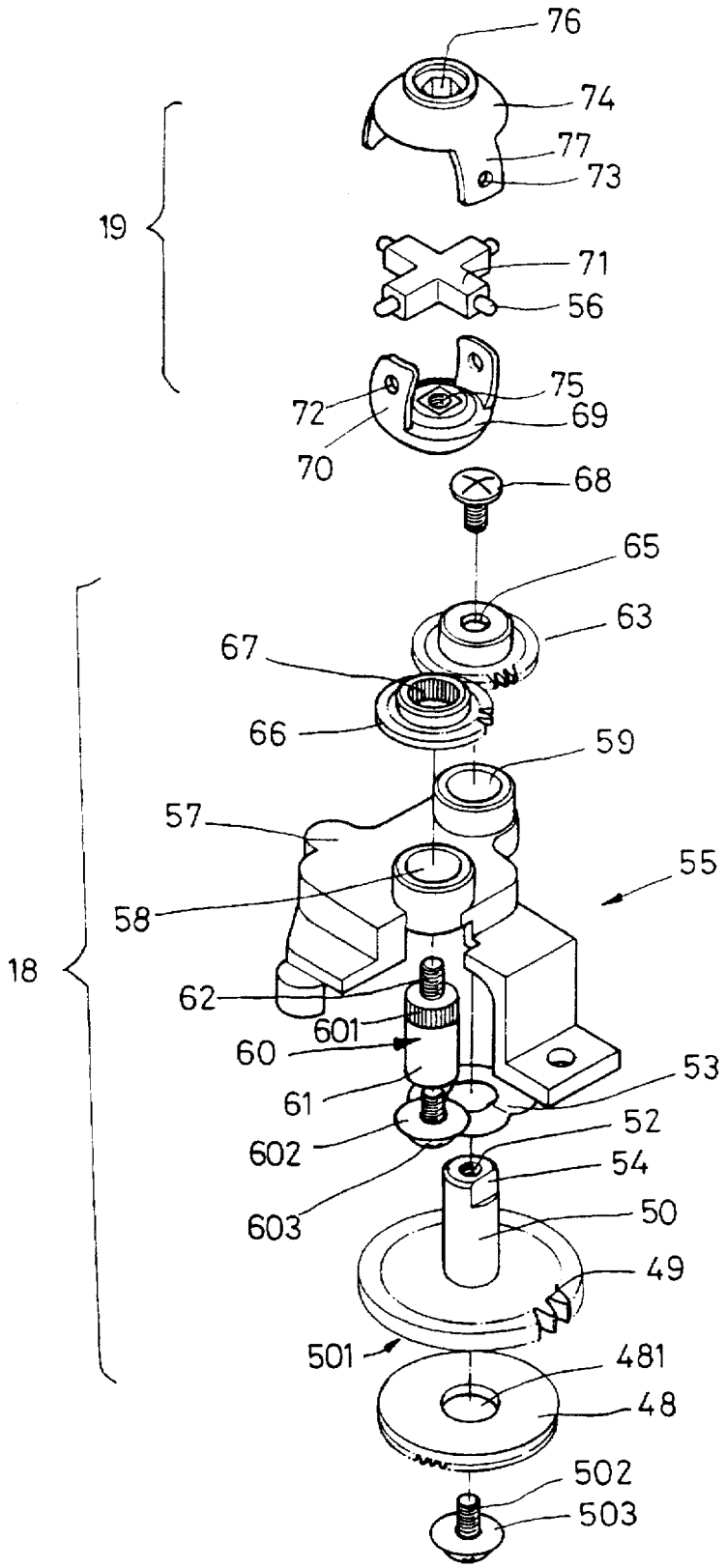
FIG. 4 is a fragmental disassembled view of the present invention; showing the transmission structure thereof.
Figure 6:
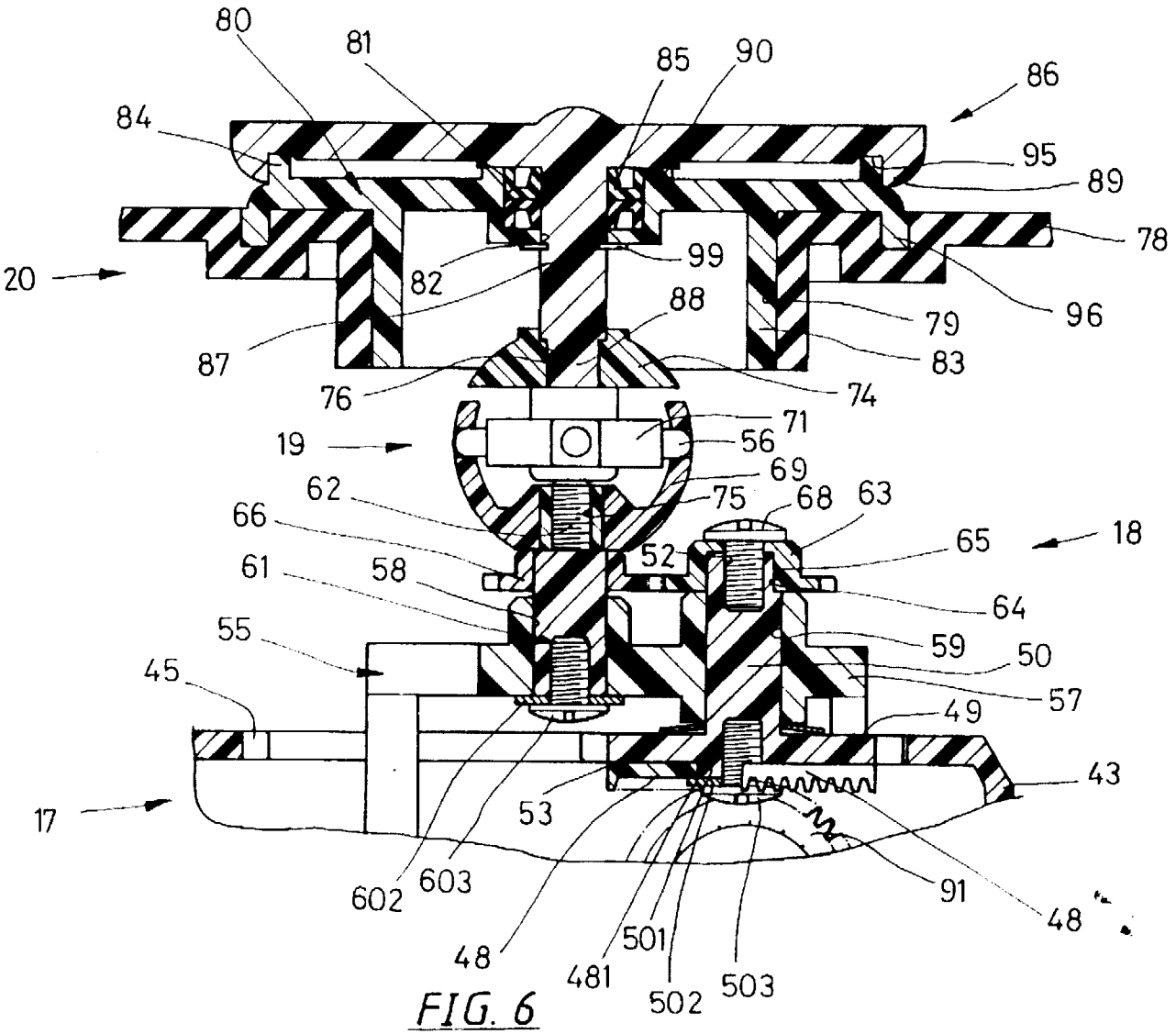
FIG. 6 is a fragmental sectional view of the present invention, showing the transmission structure thereof.

Referring to FIGS. 2, 4 and 6, the transmission structure 18 of the crystal-like ball 11 is mounted on a frame 55 over the music generator 17; the driving gear 91 of the music generator 17 engages with a crown gear 48 of the transmission structure 18 to provide a driving force. The center of the crown gear 48 has a cylindrical hole 481 for receiving a short shaft 501 under the small gear 49, and then a washer 502 and a screw 503 are mounted in place to have the aforesaid parts assembled into one piece. The small gear 49 has a rotary shaft 50 having a given length and a cut surface 54 on the upper end thereof; the center of the rotary shaft 50 has a screw hole 52 to a given depth. The frame plate 57 of the frame 55 is provided with two shaft sockets 58 and 59, of which one socket 59 is used for receiving the rotary shaft from the crown gear assembly, while the other socket 58 is used for receiving the shaft 60. The two shafts 58 and 59 engage each other through two gears 66 and 63. The shaft socket 59 is used for receiving the rotary shaft 50 with a positioning spring 53; the cut surface 54 of the rotary shaft 50 passes through the shaft socket 59, and then is mounted with a transmission gear 63 to be fixed in place with a screw 68. The crown gear 48 and the driving gear 91 of the music generator 17 engage each other; by means of the transmission gear 63 on the shaft socket 59 and other parts, the ornament 14 in the glass ball 12 can be driven to rotate; the small gear 49 and the inner gear 45 of the ring member 43 can drive the ornament 15 on the top surface 27 of the turntable 29 in rotation.

The cylindrical hole 481 of the crown gear 48 is connected with the short shaft 501 under the small gear 49, and is fixed in place by means of a washer 502 and a screw 503. After the crown gear 48 is pressed with the screw 503, the crown gear 48 and the small gear 49 will be in close contact so as to provide sufficient force to drive the small gear 49 to rotate. When the crown gear 48 is driven with the driving gear 91 of the music generator 17, it will be driven by the driving gear 91 continuously as long as the parts driven by the small gear 49 receive a resistant force. When the contact surface between the crown gear 48 and the small gear 49 becomes slippery, the small gear 49 will not move, i.e., the crown gear 48 will rotate around the short shaft 501 of the small gear 49. The aforesaid pressing-contact method can prevent the engaged parts from improper transmission or damage in case the parts or the ornament are hindered with an unintentional resistance and try to move continuously.

The other shaft socket 58 on the frame plate 57 is used to mount a round shaft 61, and a shaft 60 with a threaded portion 62; the threaded portion 62 at the end of the round shaft 61 is furnished with a vertically thread portion 601, which is to be engaged with a vertical thread hole 67 in driven gear 66. The driven gear is to be inserted from an up-and-down direction over the shaft socket 58. The driven gear 66 is to be engaged with the transmission gear 63 on the shaft socket 59; one end of the round shaft 61 of the shaft 60 has a screw hole; after the shaft 60 passes through the shaft socket 58, the screw hole is mounted with a screw 603 and a washer 602 so as to have the shaft 60 mounted in the shaft socket 58 of the frame plate 57. The threaded portion 62 on the upper part of the driven gear 66 is to be connected with a connecting member 69 of a universal joint 19. The two gears 66 and 63 are engaged together on the two shaft sockets 58 and 59 of the frame plate 57; a driving force can be transmitted, through the small gear 49 driven by the crown gear 48, and the rotary shaft 50 on the small gear, to the driven gear 66. Through the universal joint 19 and the rotary structure 20, the ornament 14 in the glass ball 12 will be driven to rotate.

The universal joint 19 is mounted between the rotary structure 20 and the transmission structure 18; a cross member 71 is used for connecting two connecting members 69 and 74; each end of the cross member 71 is furnished with a stub rod 56 to be mounted in pinholes 72 and 73 of symmetrical arms 70 and 77 of the two connecting members 69 or 74 so as to form the universal joint. The connecting member 69 is connected with the threaded portion 62 of the shaft 60 through the screw hole 75; the other connecting member 74 has a positioning hole 76 to be connected with a connecting rod 88 of the rotary structure 20 so as to provide the rotary structure 20 with a driving force.

Figure 5:
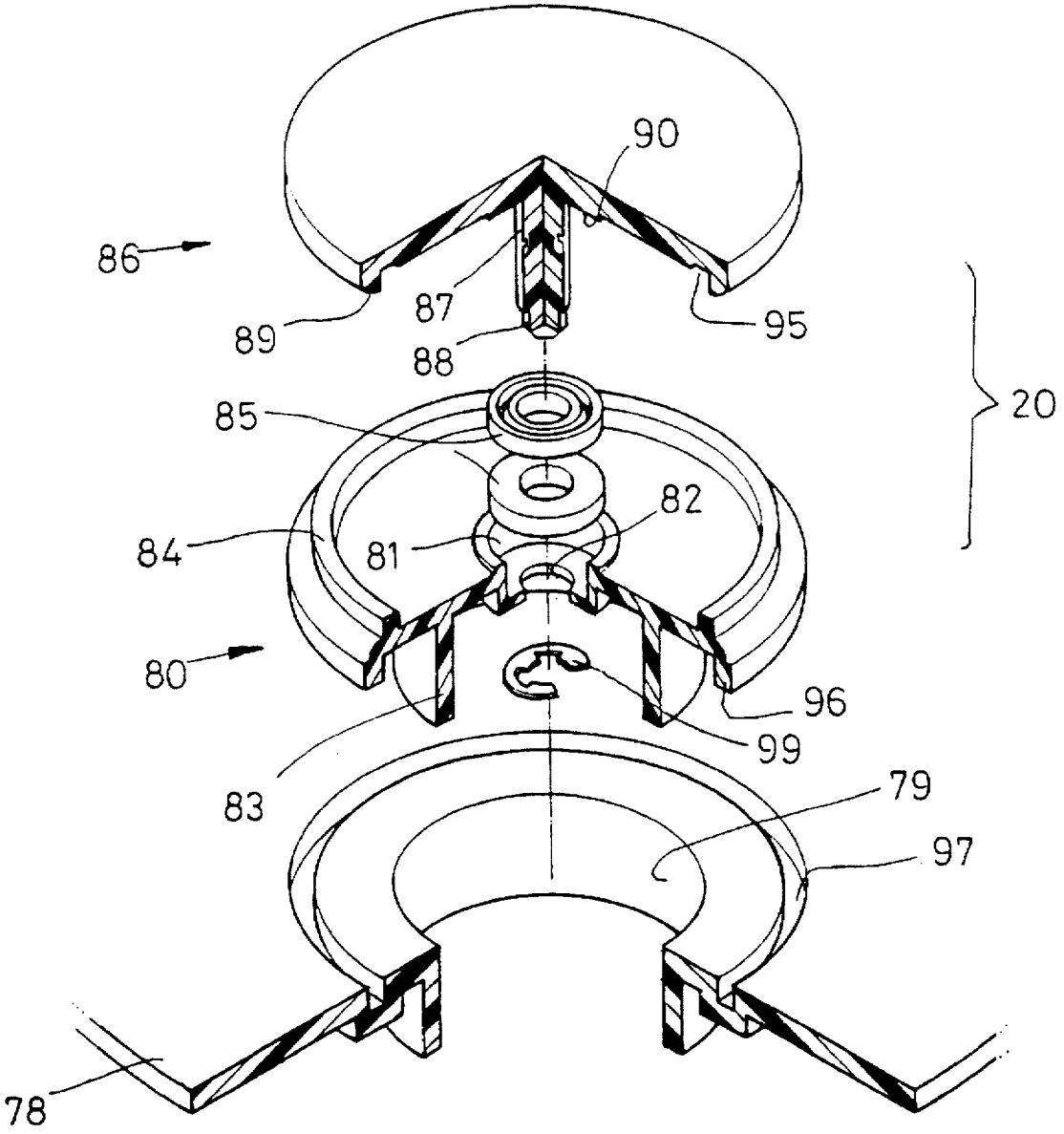
FIG. 5 is a fragmental disassembled view of the present invention; showing the rotary structure thereof.

Referring to FIGS. 2, 5 and 6, the open end of the glass ball 12 is sealed with a rubber seal 78 to prevent the water therein from leaking; the center of the rubber seal has a tube-shaped round hole 79 to facilitate the rotary structure 20 to extend from the inside of the glass ball 12 to the outside thereof. The rotary structure 20 includes a positioning disk 80, a shaft seal 85 and a turntable 86; the positioning disk 80 has a flange 96 extending downwardly to engage a contact ring 97 of the rubber seal 78. The lower edge of the positioning disk 80 has a cylindrical member 83 to be mated with the tube-shaped round hole 79 of the rubber seal 78 so as to provide a close contact between the positioning disk 80 and the rubber seal 78 and to prevent the water in the glass ball 12 from leaking out. The outer upper edge of the positioning disk 80 has a ring flange 84; the center of the positioning disk 80 has a shaft seal seat 81, of which the bottom has a center hole 82 for mounting at least one shaft seal 85. The shaft seal seat 81 has a flange extending upwardly. The ornament 14 in the glass ball 12 is glued to the top surface of the turntable 86, and the bottom center of the turntable 86 has a shaft 87 with a retaining groove and a connecting rod 88. The shaft 87 is mounted with at least a shaft seal 85, and then is passed through center hole 82 of the shaft seal seat 81 in the positioning disk 80; then, shaft seal 85 is mounted in the shaft seal seat 81 of the disk 80; then, the retaining groove passes through the center hole 82, and a retaining ring 99 is mounted in place to prevent the turntable 86 from being detached. The bottom side of the turntable 86 has a round salient surface 90 around the shaft 87, and the diameter of the round salient surface 90 is slightly larger than that of the flange of the shaft seal seat 81 so as to facilitate the round salient surface 90 and the flange of the shaft seal seat 81 to be in close contact. The outer lower edge of the turntable 86 has an outer flange 89 with a contact groove 95. The outer flange 89 of the turntable 86 is larger than the diameter of the ring flange 84 of the positioning disk 80 so as to enable the inner edge of the outer flange 89 to cover around the outer surface of the ring flange 84; the contact groove 95 will engage with the top side of the ring flange 84 so as to support the weight of the ornament 14 on the turntable 86, i.e., to have the weight of the ornament 14 distributed on the ring flange 84 evenly. The shaft 87 in the center of the turntable 86 is mounted with shaft seal 85 before passing through the center hole 82 and connecting with the universal joint 19; the shaft 87 of the turntable 86 and the shaft seal seat 81 of the positioning disk 80 can have a perfect seal by means of the shaft seal 85.

Figure 7:
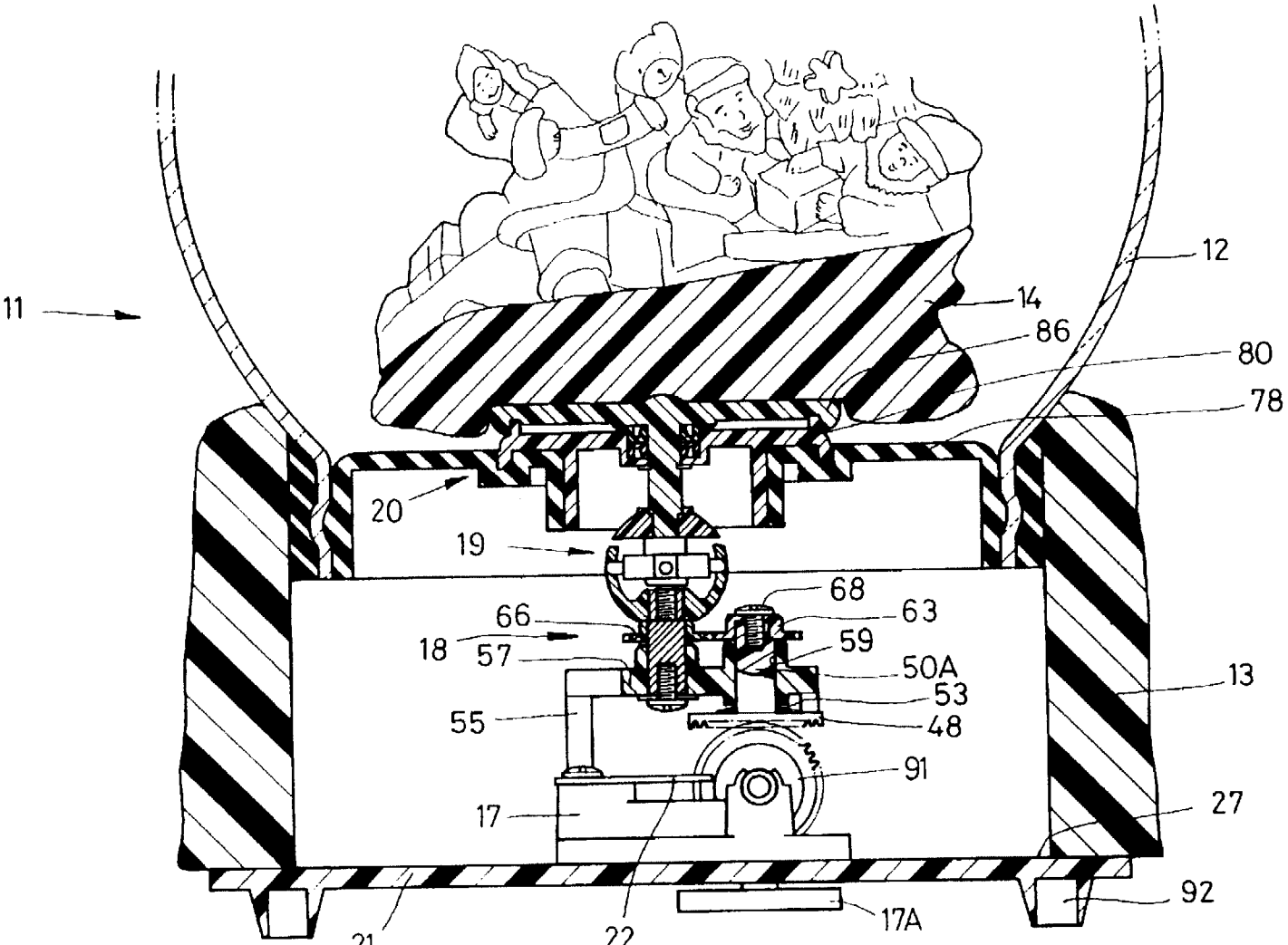
FIG. 7 is sectional view of the present invention, showing the transmission structure of the ornaments in the glass ball thereof.
Figure 8:
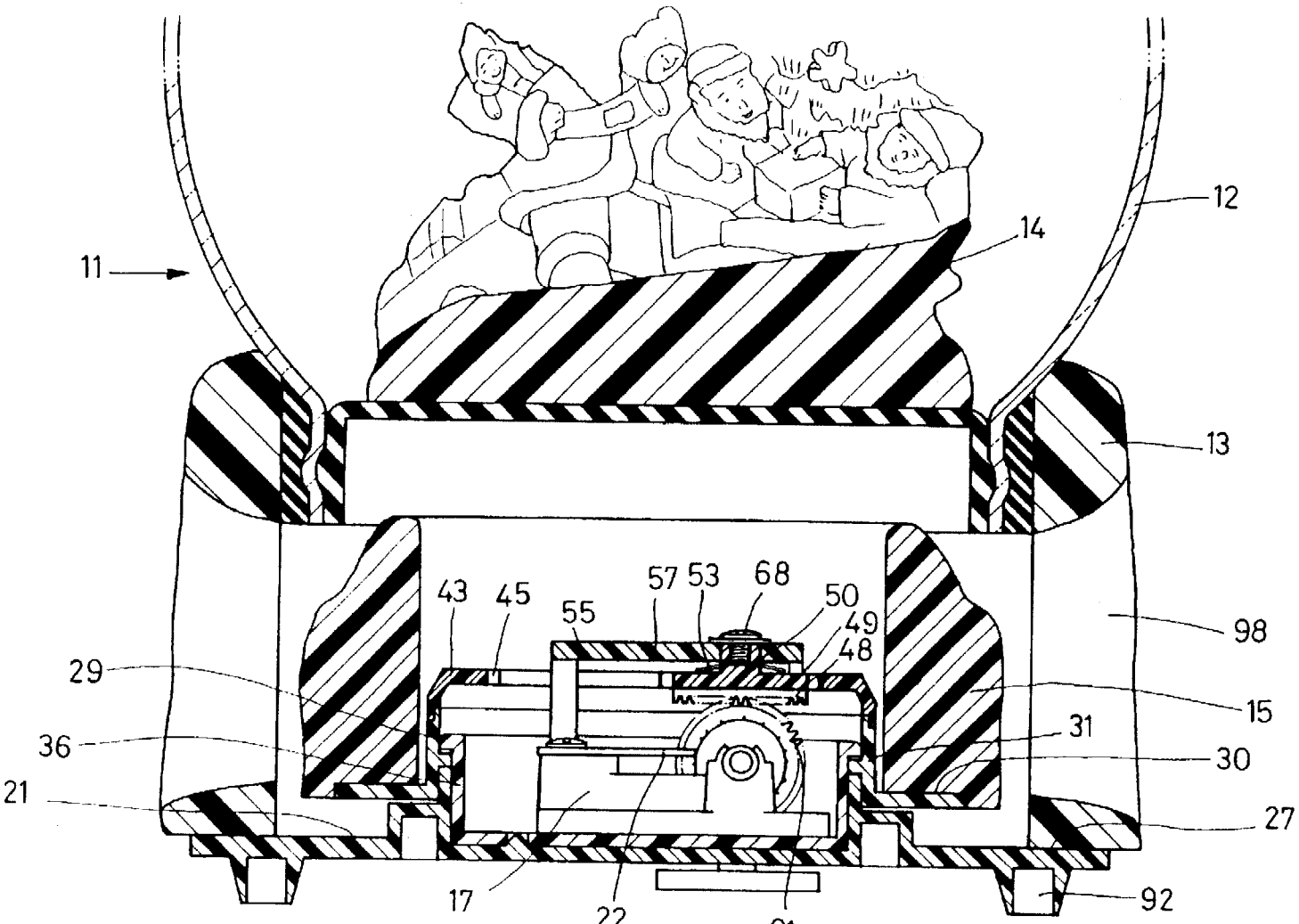
FIG. 8 is a sectional view of the present invention, showing the transmission structure in the ornaments thereof.

As shown in FIG. 7, the ornament 13 under the open end of the glass ball 12 is a still ornament; the flat surface 94 connected with the music generator 17 is on the same level with the top surface 27 of the base disc. The bottom of the hollow ornament 13 is substantially a hollow ring-shaped member glued to the top surface 27 of the base disc 21; a frame 55 is fastened to the top of the music generator 17, which is engaged with the crown gear 48 through the driving gear 91. The top of the crown gear 48 has a rotary shaft 50A for transmitting a driving force, through two gears 63 and 66, and the universal joint 19, to the turntable 86 in the glass ball 12. In another embodiment as shown in FIG. 8, the ornament 14 in the glass ball 12 is a still member; a movable ornament 15 is mounted inside the ornament 13 and under the glass ball 12. The ornament 13 is glued to the top surface 27 of the base disc 21; the inner top surface 23 of the base disc 21 and the projected ring 28 are mounted with a turntable 29, of which the ring surface 30 is glued together with the ornament 15. The inside of the salient ring 31 of the turntable 29 is mounted with a positioning disk 36; the ring shoulder 35 of the salient ring 31 is connected with a ring member 43, in which the inner gear 45 engages with the small gear 49. The flat bottom 40 of the positioning disk 36 is mounted with the music generator 17 by means of screws; a frame 55 is fixedly mounted to the music generator 17, which is engaged with the crown gear 48 through the driving gear 91. The crown gear 48 can drive the small gear 49 to actuate the ring member 43 to rotate so as to have the ornament 15 on the turntable 29 rotated.

According to the aforesaid description of the embodiments, the features and structure of the present invention have been disclosed completely; it is apparent that considerable improvement has been made in the present invention, and it has never been anticipated by any one who is skilled in such art; therefore the present invention is deemed unique in terms of structure.

I claim:

1. An ornamental crystal ball comprising:

a base including a base disc, a first turntable, a first positioning disc and a ring member, said base disc having a projected ring on a center thereof and having a flat surface inside of said projected ring, said base disc having an inner top surface and a second outer top surface at different heights; a center of said first turntable having a salient ring with an outer edge having a ring surface; said center of said first turntable inside of said salient ring having an upper surface and a lower surface partitioned with a flange; said lower surface mounted on an upper side of said projected ring of said base disc; said upper surface mounted with a positioning flange on said first positioning disc being substantially a cylinder; a bottom of said first positioning disc having a flat surface like that of said base disc, and said bottom having positioning flanges extended upwards; said first positioning disc being inserted into said salient ring and said projected ring of said first turntable and said base disc respectively; said positioning flanges of said first positioning disc being mounted on said upper surface of said first turntable; a bottom of said ring member being assembled with a ring shoulder of said salient ring; said ring member having an upper inside with an inner gear;

a music generator mounted and fastened in said first positioning disc of said base and including a driving gear adjacent to a music drum of said music generator;

a transmission mounted above said music generator with a frame, said frame having a frame plate with two shaft sockets, one of said two shaft sockets being mounted with a rotary shaft of said small gear, said small gear having a short shaft connected with a crown gear, said crown gear engaging said driving gear of said music generator; said rotary shaft under said one shaft socket engaging said inner gear of said ring member of said base via said small gear; said rotary shaft on said one shaft socket being mounted with a transmission gear which is engaged with a driven gear on said other shaft socket;

a universal joint mounted between a rotary structure and said transmission; a cross member connecting two connecting members together with ends of said cross member having stub rods inserted into corresponding pin holes of two symmetrical arms respectively; a screw hole of one of said two connecting members engaging a threaded portion on an upper part of a shaft of said transmission structure; an other of said two connecting members having a positioning hole;

a rotary structure including a second positioning disc, a shaft seal and said second turntable; a lower edge of said second positioning disc having a cylindrical member connected with a rubber seal of a tube-shaped round hole, and said second positioning disc having a center with a shaft seal seat and a center hole; a lower center of said second turntable having a shaft mounted with at least one shaft seal mounted in said shaft seal seat in said center of said second positioning disc, and said connecting rod on an end thereof being connected with said positioning hole of said connecting member of said universal joint;

an ornament having an upper edge and a bottom edge fastened to an outer edge of a top surface of said base disc of said base; and, a glass ball having an open end mounted with a rubber seal, and a center with a tube-shaped round hole connected hermetically with said second positioning disc of said rotary structure; an outer edge of said open end of said glass ball mounted on an upper edge of said ornament.

2. The ornamental crystal ball as claimed in claim 1, wherein said base disc of said base is provided with said projected ring connected with an inner side of said first turntable; said projected ring of said base disc having a height larger than that of said lower surface of said salient ring in said first turntable; a lower side of said flange in said first turntable being in contact with an upper edge of said projected ring on said base disc; a ring surface of said first turntable and said inner top surface of said base disc being spaced apart from each other.

3. The ornamental crystal ball as claimed in claim 1, wherein an outer edge of said projected ring of said base disc has two top surfaces comprising an inner top surface having a height slightly higher than an outer top surface, said outer top surface being attached to the bottom of said ornament.

4. The ornamental crystal ball as claimed in claim 1, wherein an upper edge of said salient ring on said first turntable of said base has a ring shoulder connected with a contact portion under said ring member.

5. The ornamental crystal ball as claimed in claim 1, wherein said first positioning disc of said base comprises a substantially vertical member having a bottom with a flat surface in contact with said flat surface of said base disc; said vertical member having a plurality of positioning slots of different sizes.

6. The ornamental crystal ball as claimed in claim 1, wherein one end of said crown gear in said transmission structure engages said driving gear of said music generator; a center of said crown gear having a cylindrical hole mounted on said short shaft under a center of said small gear by a washer and a screw; a top side of said small gear having a rotary shaft, said rotary shaft having an upper end with a screw hole and a cut surface; and wherein upon said rotary shaft passing through said shaft socket of said frame plate, said cut surface is connected with a positioning seat of said transmission gear and is fixed in place with a screw.

7. The ornamental crystal ball as claimed in claim 1, wherein said shaft socket on said frame plate of said transmission structure is connected on said rotary shaft of said small gear; a positioning spring being mounted between a lower end of said shaft socket and said small gear so as to provide a resilient force urging said crown gear and said driving gear into engagement.

8. The ornamental crystal ball as claimed in claim 1, wherein said shaft socket on said frame plate of said transmission structure mounts a shaft with a round shaft and thread portions; a vertical threaded portion adjacent to said thread portion being connected with a vertical threaded hole of said driven gear; said shaft being inserted into said shaft socket from an upper end thereof, and a lower end of said shaft being mounted with a screw and a washer under a lower end of said shaft socket; an upper end of said shaft socket being connected with said universal joint by means of said threaded portion; said driven gear on an outer end thereof being engaged with said transmission gear on said other shaft socket.

9. An ornamental crystal ball comprising:

a base disc having a bottom with a plurality of support studs, and a center having a projected ring, said projected ring having an inside with a flat surface, a top surface mounted with a turntable and an outer edge having an inner top surface and an outer top surface of different heights, wherein said inner top surface is higher than said outer top surface;

a turntable with a top center having a salient ring, an outer edge of said salient ring having a ring surface, an inner surface of said turntable having a flange to partition an upper surface and a lower surface; said lower surface being mounted on an upper side of said projected ring of said base disc;

a positioning disc having a flat bottom in contact with said base disc and having a space for receiving a music generator; an upper side of said positioning disc having said positioning flange and an outer edge mounted in said salient ring of said turntable and said projected ring of said base disc; said positioning flange being mounted in a space in said upper surface of said turntable;

a ring member having a lower edge connected with a ring shoulder of said salient ring of said turntable, and an inner surface having an inner gear;

a music generator being mounted and fastened in said space of said positioning disc and having a driving gear of a music drum of said music generator;

a frame mounted over said music generator;

a crown gear on said frame and having a rotary shaft inserted in said shaft socket, said crown gear engaging said driving gear of said music generator, said crown gear having a center with a cylindrical hole mounted on a short shaft;

a small gear having said short shaft being fitted in said cylindrical hole of said crown gear; said rotary shaft being inserted in said shaft socket of said frame and being mounted in place with a washer and a screw; an outer edge of said small gear engaging said inner gear of said ring member;

a positioning spring mounted on said rotary shaft between said small gear and said frame;

an ornament with a bottom edge; and, a glass ball having an open end mounted with a rubber seal, and a top side of said rubber seal being glued with said ornament; an outer edge of said open end of said glass ball being mounted with said ornament with said bottom edge being glued on an outer top surface of said base disc.

10. The ornamental crystal ball as claimed in claim 9, wherein a top side of said base disc has said projected ring connected with said inner surface of said turntable; a height of said projected ring being higher than that of said lower surface in said salient ring of said turntable; a lower side of said flange of said turntable being contacted with an upper side of said projected ring; and a bottom of said ring surface of said turntable and said top surface of said base disc being spaced apart from each other.

11. The ornamental crystal ball as claimed in claim 9, wherein said outer top surface of said base disc is glued together with said ornament, said ornament having a transparent surface so as to facilitate seeing a rotary ornament glued to said ring surface of said turntable.

12. The ornamental crystal ball as claimed in claim 9, wherein a lower edge gear of said crown gear is engaged with said driving gear of said music generator, said crown gear being mounted to said short shaft by using a screw and a washer to fix said screw into a screw hole of said short shaft; a lower side of said small gear being in contact with an upper side of said crown gear so as to rotate said turntable of said base.

13. The ornamental crystal ball as claimed in claim 9, wherein said lower edge gear of said crown gear is engaged with said driving gear of said music generator; and said small gear is engaged directly with said inner gear of said ring member.

14. An ornamental structure ball comprising:

a base disc comprising a substantially round disc having a bottom side with a plurality of support studs, and a center having a flat surface and an outer top surface;

a music generator fastened on said base disc and including a driving gear inside a music drum;

a frame mounted over said music generator; said frame having a frame plate with first and second shaft sockets receiving a rotary shaft of said crown gear on said driving gear and a shaft connected with a driven gear;

a crown gear having a lower edge with a gear engaging said driving gear of said music generator; and having a rotary shaft at a center thereof passing through said first shaft socket;

a transmission gear connected with said rotary shaft in said first shaft socket on said frame, said transmission gear fastened to said rotary shaft; said transmission gear engaging a driven gear;

a shaft including a round shaft portion and a threaded portion; said round shaft portion being mounted in said shaft sockets, and said threaded portion being connected to said second shaft socket to connect with said driven gear said driven gear being mounted on said shaft in said first shaft socket on said frame; an outer edge thereof being engaged with said transmission gear;

a universal joint being mounted between a rotary structure and a transmission structure; a cross member connecting two connecting members together with ends of said cross member having stub rods inserted into corresponding [pin holes of two symmetrical arms respectively of said universal joint; a screw hole of one connecting member engaging a threaded portion on an upper part of a shaft of a transmission structure, said other connecting member having a positioning hole;

a rotary structure including a positioning disc, a shaft seal and a turntable; a lower edge of said positioning disc having a cylindrical member connected with a rubber seal of a tube-shaped round hole, and a center of said positioning disc having a shaft seal seat and a center hole; a lower center portion of said turntable having a shaft mounted with at least one shaft seal in said shaft seal seat in said center of said positioning disc and a connecting rod being connected on an end with said positioning hole of said connecting member of said universal joint;

an ornament having an upper edge and a bottom affixed to an outer edge of a top surface of said base disc; and a glass ball having an open end mounted with a rubber seal, and a center thereof having a tube-shaped round hole connected hermetically with said positioning disc of said rotary structure and an outer edge of said open end of said glass ball being mounted on an upper edge of said ornament.

* * * * *